United States Patent [19]

Baldorossi et al.

[11] 4,359,225

[45] Nov. 16, 1982

[54] GAME BALL ENTRAPMENT DEVICE

[76] Inventors: Blanche N. Baldorossi; Raymond F. Baldorossi, both of 3702 Meadowbrook Ave., Orlando, Fla. 32808

[21] Appl. No.: 963,822

[22] Filed: Nov. 27, 1978

Related U.S. Application Data

[60] Continuation-in-part of Ser. No. 800,842, May 26, 1977, abandoned, which is a division of Ser. No. 573,773, May 1, 1975, Pat. No. 4,026,561.

[51] Int. Cl.[3] ..... A63B 69/36

[52] U.S. Cl. ..... 273/178 A

[58] Field of Search ..... 273/178 R, 177 R, 177 A, 273/177 B, 178 A, 180

[56] References Cited

U.S. PATENT DOCUMENTS

| | | | |
|---|---|---|---|
| 1,076,722 | 10/1913 | Treadwell | 273/178 A |
| 1,112,075 | 9/1914 | Lush | 273/178 A |
| 1,229,766 | 6/1917 | Long | 273/178 A |
| 1,712,561 | 5/1929 | Jaspert | 273/180 |
| 1,823,487 | 9/1931 | Clear | 273/178 A |
| 2,283,462 | 5/1942 | Richie | 273/178 A |
| 3,086,779 | 4/1963 | Taylor | 273/178 R X |

FOREIGN PATENT DOCUMENTS

| | | | |
|---|---|---|---|
| 155711 | 12/1920 | United Kingdom | 273/178 A |
| 195328 | 3/1923 | United Kingdom | 273/178 A |

*Primary Examiner*—George J. Marlo
*Attorney, Agent, or Firm*—Julian C. Renfro

[57] ABSTRACT

A ball entrapment device particularly designed for use in a golfing game such as "Softgolf", which game involves the use of a lightweight ball some five inches in diameter for example, whose weight to size relationship is such that the ball will not travel very far, even when hit by an appropriately oversized golfclub, using the same forceful swing that a golfer uses in playing regulation golf. Our ball trap utilizes a plurality of individual tines, which are placed at evenly spaced intervals about the interior of a ring-shaped supporting member. These tines are angled inwardly, and are flexibly mounted so as to deflect downwardly under the weight of an approaching ball, such that the ball can readily enter the trap. These fingers are quite resilient, such that they quickly regain their original angled relationship to the supporting surface. After the ball has passed through the center of the trap, it encounters other tines on the far side of the trap, the tips of which tines typically encounter a mid portion of the ball. Because the tine membes have column strength, they do not bend, but rather serve as an effective means for stopping the ball such that it does not leave the trap. If the ball tends to rebound, it then encounters the tips of the tines over which it had originally passed, which prevent the ball from leaving the trap in the direction from which it had come. Other features of our trap include vane like members that tend to turn the ball into the trap, even when it is approaching in a direction not precisely aligned with the center of the trap.

13 Claims, 13 Drawing Figures

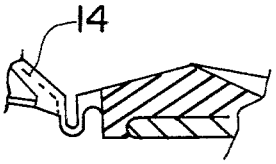
FIG. 3e
FIG. 3a
FIG. 3b
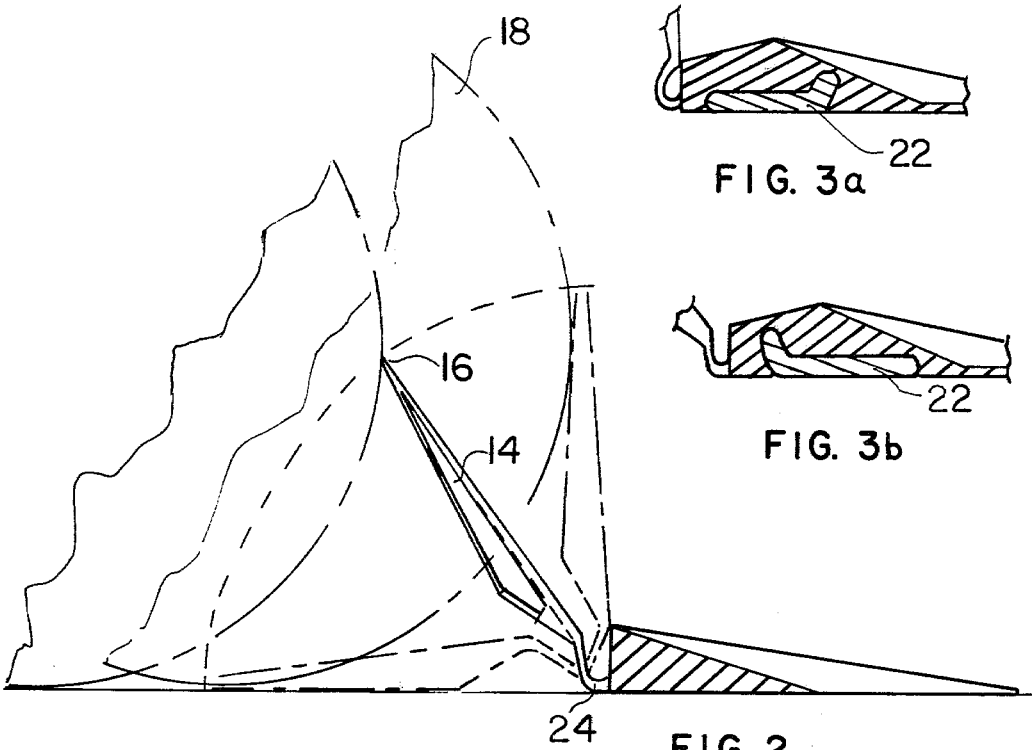
FIG. 2
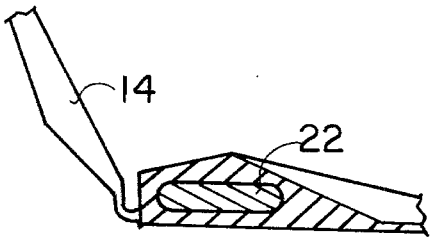
FIG. 3d
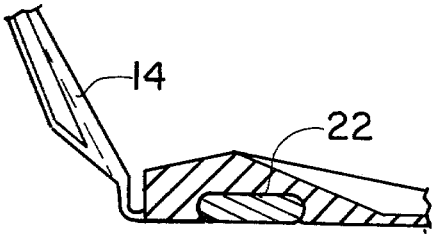
FIG. 3c

GAME BALL ENTRAPMENT DEVICE

RELATIONSHIP TO EARLIER INVENTION

This is a continuation-in-part of our application entitled "Ball Trap for Use in the Impromptu Arranging of Specialty Sports and Practice Thereof", Ser. No. 800,842, filed May 16, 1977, now abandoned which in turn was a division of our application Ser. No. 573,773 filed May 1, 1975, now U.S. Pat. No. 4,026,561.

BACKGROUND OF THE INVENTION

In the past, others have designed and utilized ball traps for use with golf games, and one example is a patented device which utilizes a cup involving a circular disc, around the rim of which is an upstanding lip or guard in the form of a truncated cone. The lip may be formed of relatively thin, flexible rubber, and tapering to a relatively thin edge at the periphery of the combined lip and base. An approaching ball encountering the lip causes it to depress sufficient so that the ball can enter the cup and then be stopped by the lip on the opposite side. One important disadvantage of such device involves the fact that a ball approaching the trap at an angle will be caused by the steep lip to veer to one side, rather than entering the trap.

While a device of this type may be satisfactory for use with golf balls of conventional size, it would be useless for use with large lightweight balls of the size employed in accordance with the teachings of our U.S. Pat. No. 4,026,561, wherein a golf game known as "Softgolf" utilizes balls weighing approximately two ounces, which may be some five inches in diameter. This is because a trap in accordance with the teaching of the patented device that is increased in size in order to accomodate a "Softgolf" ball would necessarily have lip edges that are comparatively thick, which would mean that they might well be so resistant to the entry of a lightweight foam ball, that the ball would travel up the sloped forward edge of the trap and actually jump over the trap rather than entering it.

Another device of the prior art more nearly like the present invention in that it utilizes a plurality of upstanding flexible fingers disposed about its periphery at spaced locations is the British Pat. No. 155,711 to Patton, which uses fingers tapered slightly inward toward a common apex. Such a device, however, does not employ fingers which are designed to have column strength, such that they present an effective obstacle to the ball as it approaches the far side of the trap. Rather, the patent to Patton restrains balls from leaving by the joint action of the fingers and of the pads, hooks or the like inwardly projecting at the upper ends of the fingers.

Missing entirely from all known prior art devices is the use of turning members such that a ball approaching the trap in a relationship other than moving toward the center of the trap will turn and enter the trap properly rather than being deflected off the rim of the trap.

It was to overcome the many disadvantages of ball traps in accordance with this and other prior art that the present invention was designed.

SUMMARY OF THE INVENTION

A ball entrapment device in accordance with this invention comprises a ring-shaped member a foot or so in diameter for use with a ball approximately five inches in diameter, and proportionately larger or smaller for use with a ball of another size. About the inner portion of the trap, a series of tines are hingedly disposed in spaced relation. The tines each have an essentially straight body portion that slants inwardly, and these body portions normally reside at say a 35° to 55° angle to the floor or other supporting surface. As a ball approaches the entrapment device, it therefore first encounters tines that are sloping away from the path of travel of the ball, with the result that two or perhaps three or more of these tines directly contacted by the lightweight ball hinge downwardly about their respective mountings so as to present minimum resistance to the entry of the ball into the central portion of the trap. In other words, the ball passes over the body portions of two or more tines as they temporarily reside in a horizontal position.

After the ball has entered the trap sufficiently far, the finger-like tines over which the ball has passed quickly resume their original angled relationship.

The tines on the far side of the trap from the entering ball are at an inclination to best encounter the ball after it has passed through the central portion of the trap, and the tips of one or more of these tines are contacted by the ball at such time as it approaches the far side of the trap from the entry point.

Because the tines in accordance with this invention individually possess a substantial amount of rigidity in the sense of having column strength, and inasmuch as they are inclined at an angle to best resist the continued motion of the ball, the two or so tines or fingers encountered by the ball act to arrest its forward motion. Inasmuch as the tines at the entry point will have already rotated about their respective hinge points so as to resume their original, ball-resistant inclination, if the ball rebounds after contacting the tines opposite the entry point, it will then contact the tips of the tines that originally permitted passage into the trap, which tines then mainfest their column strength and act to effectively contain the ball in a mid-portion of the trap. As will be described at length hereinafter, the fingers or tines may function to stop the ball either by "chocking" it, or by "fencing" it.

This invention is adaptable for use on a variety of surfaces as an entrapment device for balls of various sizes, although it was primarily developed for use with balls of lightweight foam construction, such as those described in our U.S. Pat. No. 4,026,561, and in our copending application Ser. No. 800,843, filed May 26, 1977, now U.S. Pat. No. 4,150,826.

The size of the ball to be used in a given instance is of consequence to trap design, for the tips of the tines of the trap should be at a location above the base portion of the trap such that they contact the ball at its horizontal midportion, and thus minimize the tendency of the ball to jump over the tines at the location opposite the entry point of the ball into the trap.

It is important that the fingers not be individually so heavy that they do not maintain a substantial angle to the base of the trap, so we obtain column type tine strength while maintaining minimum weight by employing a cross section that is contoured to effectively resist bending.

A ball putted toward our novel trap may not always be precisely aligned with the exact center of the trap, so in order to compensate for slight misalignments, and to permit entry by a ball approaching at an angle, we provide a series of upstanding members about the periphery of the device, with the spacing of these low members being consistent with tine placement. These ball redirecting members effectively serve to provide guidance to a ball entering slightly off center, such that it moves radially inwardly, rather than tending to deflect off the rim without entering the trap.

It is therefore a principal object of the present invention to provide a ball trap usable with a ball of lightweight foam several inches in diameter, thus enabling a golfer pursuing a golfing game such as "Softgolf" to practice putting inside a building or out of doors on any suitable surface.

It is another object of this invention to provide a ball trap utilizing a plurality of inwardly-directed fingers or tines, arrayed in spaced relation about a ring shaped member, with such fingers being effectively hinged and possessing sufficient column strength as to turn back a ball from the far side of the trap in a highly effective manner.

It is yet another object of this invention to provide a ball trap utilizing a series of spaced, inwardly-turned fingers or tines, so shaped and deployed as to aid in the directing of an approaching ball into the trap.

It is yet still another object of this invention to provide a ball trap having ramp means about its periphery such that a ball approaching at any of a wide range of angles to the trap will be directed so as to enter the trap without tending to be deflected off an edge of the trap.

It is yet still another object of this invention to provide a ball trap of highly advantageous and low cost design, utilizing a plurality of hinged, resilient fingers that are molded integrally with the interior side of a ring-shaped member defining the body portion of the trap.

It is still another object of this invention to provide a ring-shaped ball trap utilizing a series of spaced, inwardly directed fingers whose tips can encounter a ball of one size in a "chocking" relationship in order to arrest the motion thereof, and which fingers can bring about the stopping of a ball of another size by means of a "fencing" type action.

These and other objects, features, and advantages will be more apparent as the description proceeds.

BRIEF DESCRIPTION OF DRAWINGS

FIG. 2 is a fragmentary view to a larger scale showing the interaction between a ball located in the trap, and one of the tines numerously placed about the inner periphery of the trap in order to prevent a ball from leaving the trap;

FIGS. 3*a* through 3*e* are a series of fragmentary views showing various arrangements that may be utilized in the ring in order to bring about a desirable weighting of the trap, with these views also revealing various hinge details;

DETAILED DESCRIPTION

Figure 1:
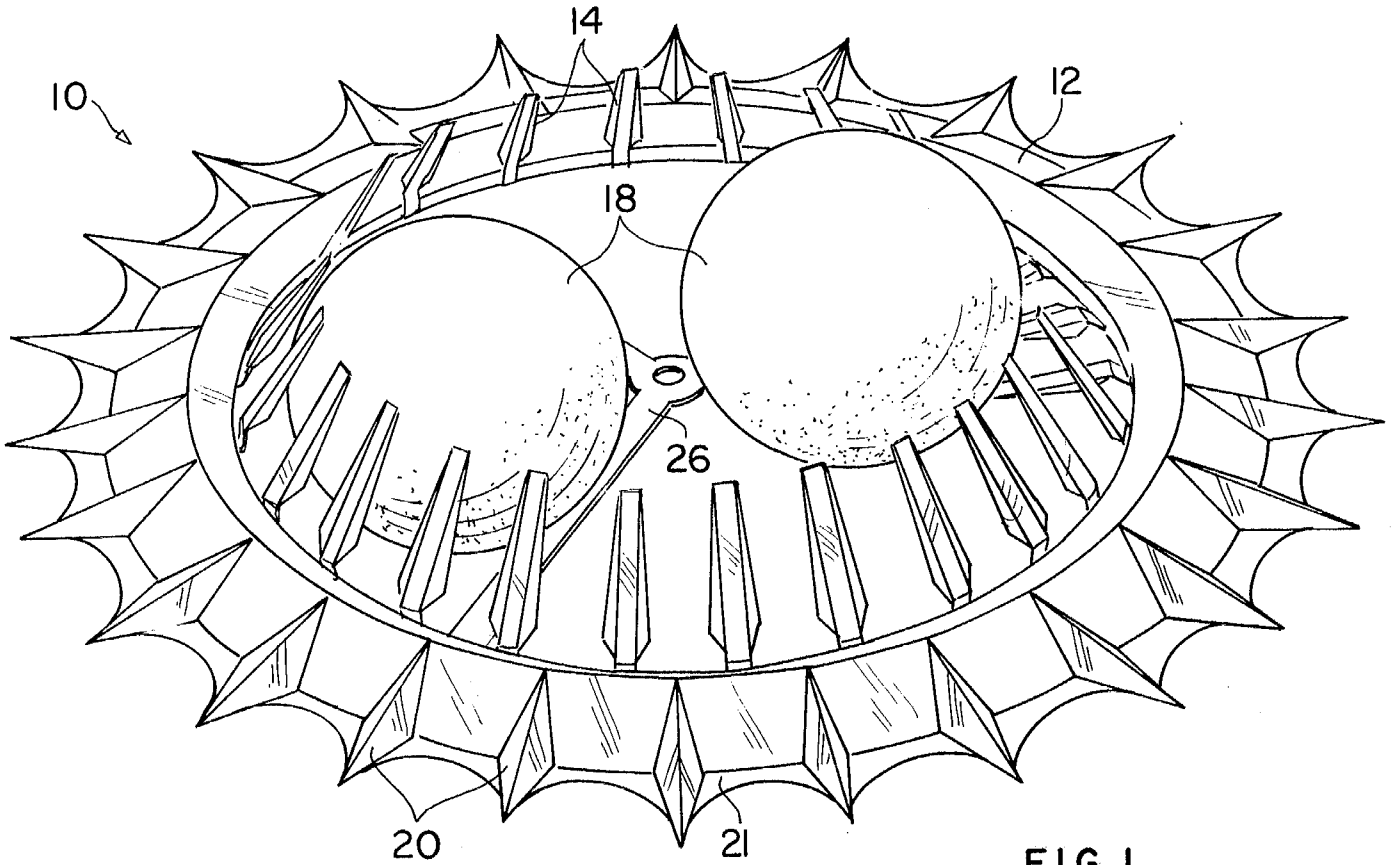
FIG. 1 is a perspective view of a ball entrapment device in accordance with our invention, showing how a ball can enter the trap by momentarily causing the downward deflection of three or more inwardly directed tines spaced about the interior portion of the generally ring-shaped trap.

Referring to FIG. 1, it will there be seen that we have illustrated an exemplary version of our ball trap 10, which is principally constituted by a ring-shaped body portion 12, around the interior portion of which a series of resilient tines or fingers 14 are hingedly disposed in spaced relation. The tines 14 normally reside at a 35° to 55° angle to the horizontally disposed center portion of the trap, with the angle typically being approximately 45°. The tines are designed to easily deflect downwardly under the weight of a ball of the type used therewith, and then quickly resume their original angularity. The inner diameter of the ring-shaped body portion 12 may, for example, be such that the two balls 18 may be accommodated in the center portion of the trap.

The ball or balls used with our entrapment device are preferably of lightweight construction, as described in our U.S. Pat. No. 4,026,561 and our copending patent application Ser. No. 800,843, now U.S. Pat. No. 4,150,826 and for example may weigh approximately two ounces and be say five inches in diameter.

The ball 18 illustrated on the right in FIG. 1 may be presumed to have just entered the trap, with three or so of the tines directly contacted by the ball having been caused to hinge downwardly about their respective mountings in order to permit entry of the ball into the central portion of the trap. In other words, each time a moving ball encounters two or more of the inwardly slanting tines, it causes them to move temporarily into an essentially horizontal position, and then, after the ball has passed, to quickly resume the inclined attitude illustrated elsewhere in FIG. 1.

As will be discussed hereinafter at length, it is desired to minimize the weight of the fingers 14 consistent with their rigidity, so that on the one hand they will not be too heavy to stand at the desired angle to the supporting surface, but on the other hand, have enough column strength that they will not tend to bend at a location other than at the flexible support point.

Also depicted in FIG. 1 are a number of ramp points 20, which are a configuration such as to encourage an approaching ball to enter the trap properly, rather than tending to deflect off the rim of the trap. Between the ramp points are webs 21. All of these details will be discussed at greater length hereinafter.

Turning to FIG. 2, it will there be seen that we have illustrated to a somewhat larger scale, a typical finger or tine 14 in accordance with this invention, and it will be noted that the tine may be of plastic and molded integrally with the ring-shaped body portion 12. As previously mentioned, each of the fingers is of lightweight construction, such that they will normally stand at an angle of say 35° to 55° to the horizontally disposed center portion of the trap.

It is the primary purpose of these fingers or tines to stop a ball after it has entered the trap, such that it will not proceed out of the other side. The tip 16 of the finger 14 is arranged to contact an approaching ball in the vicinity of its midportion, with the column strength of the tine being such that it does not buckle at any location along its length under the forward momentum of the ball. It is important to note in FIG. 2, that the hinge arrangement 24 is such as to prevent upward movement of a finger beyond a certain point, say above an angle in the vicinty of 75° to 90°. As a result of this arrangement, an entering ball, after proceeding across the center portion of the trap, is prevented from leaving the trap unless its speed is so very great that its momentum causes it to jump entirely over the fingers.

It is to be noted in connection with FIG. 2 that the tines 14 of our device may serve in different ways to arrest the rolling motion of a ball. As shown in full lines in FIG. 2, if the size relationship between the tines and a ball is such that the tip 16 of the tine contacts the ball at or below its center, a "chocking" effect stops the ball. The tines in this mode will in many instances stop a rapidly moving ball, but of course if the speed is quite excessive, the ball may escape the trap by entirely jumping over the tines.

Where the size relationship is such that the tips of the tines contact the ball above its center, the tines may bend back to a position that may approach the vertical, as shown in dashed lines in FIG. 2. When in this mode, the tines "fence" the ball rather than "chocking" it. It is important to note that the hinge relationship of each tine is such that it will not bend beyond a certain point, which is typically from 75° to 90°.

As is thus to be seen, if a ball is comparatively small it will be "fenced", whereas in the case of a larger ball, it will be "chocked" by the tine action.

The entry portion of the trap may incline upwardly at say a 5° to 10° angle to the horizontal plane, with the slope on the inner part of the ring typically being 5° to 30° downward toward the center of the trap; note FIGS. 1 and 2.

It will be noted in FIGS. 3*a*–3*e* that we have illustrated various rings 22 of metal of a type that may be affixed to the plastic in order to add weight and strength, and thereby prevent excessive distortions and undesired movement of the trap with respect to the floor, lawn, or other supporting surface. In FIG. 3*a* we show a typical stop feature for a tine hinge, and in FIG. 3*c* we illustrate a somewhat different form of tine hinge, but like the others, it prevents the respective tine from hinging upwardly beyond a certain point.

Figure 4:
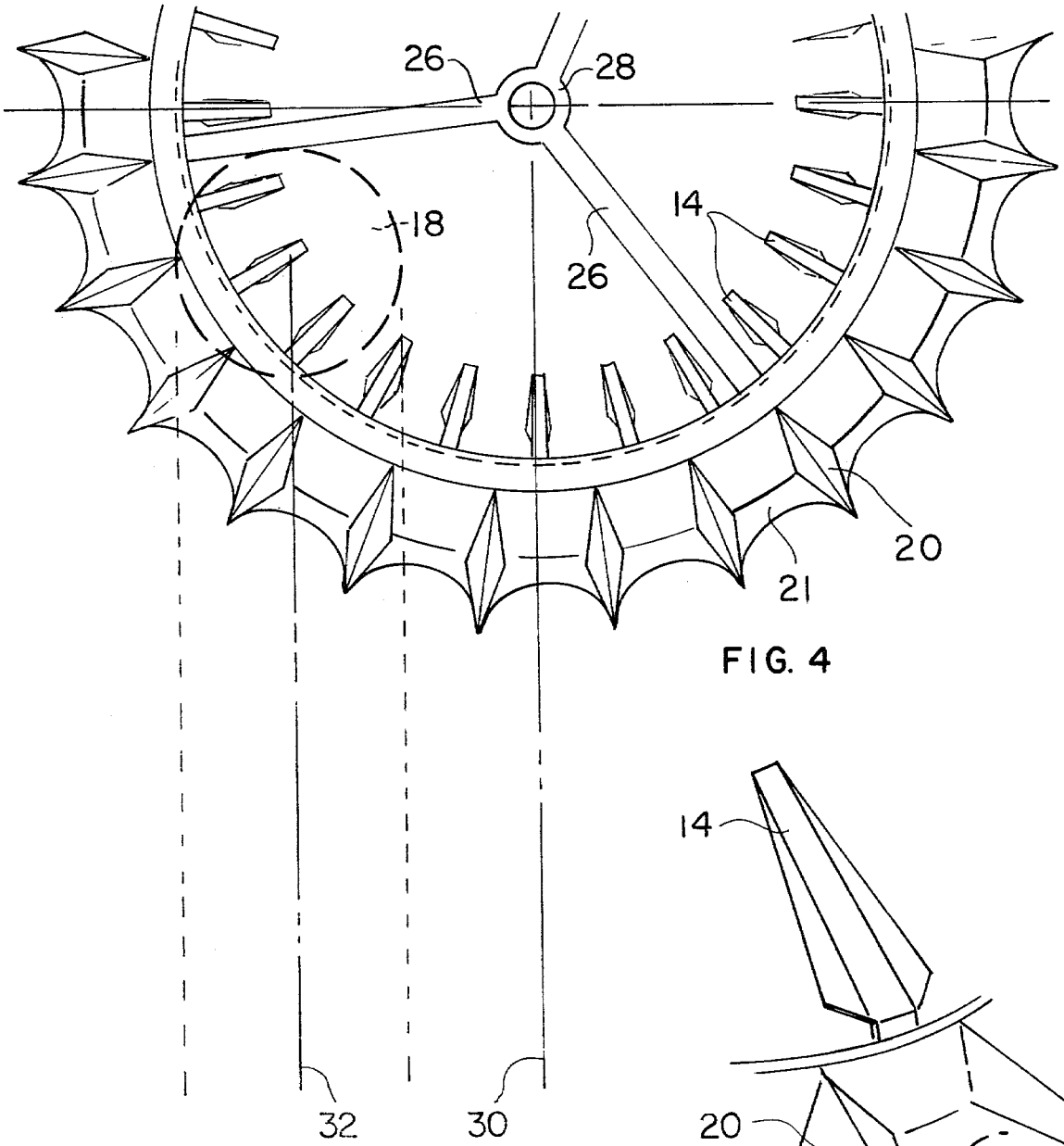
FIG. 4 is a plan view of a portion of our trap, with certain lines being utilized on one side of the trap in order to illustrate a range of relationships that may exist between an approaching ball and the center of the trap, with it to be understood that a ball can arrive on this side of the trap at any location between the lines and still enter the trap as a result of the action of the directing vanes disposed about the exterior edge of the trap.

Referring to FIG. 4, it will be noted that we here illustrate in greater detail, a typical trap in accordance with this invention, with it to be understood that say twenty-four resilient tines or fingers 14 may be utilized in spaced relation about the inner periphery of the device, although we are obviously not to be so limited, and any other satisfactory number of tines may be used in accordance with this invention.

Figure 4A:
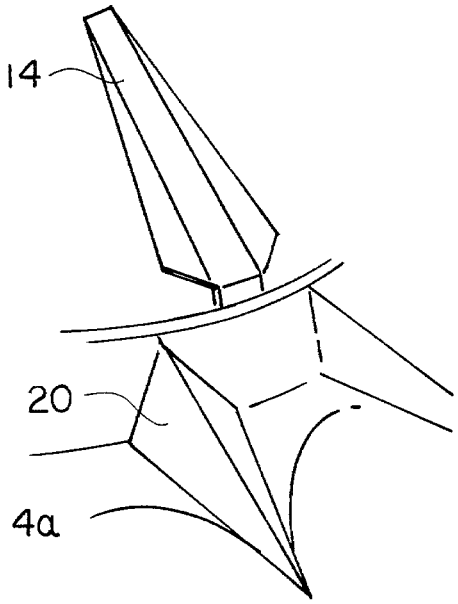
FIG. 4*a* is a fragmentary view to a larger scale, showing a preferred relationship between a tine and the adjacent turning members.

We preferably utilize ramp members 20 that desirably are equal in number to the number of tines used, with each tine being placed equidistant from the two closest ramp members 20; note FIGS. 4 and 4*a*. It is the purpose of these ramp members to act much in the order of guide vanes, and thus encourage a ball approaching at an attitude other than a path directed toward the center of the trap, to change its direction such that it properly enters the trap and thus obtain the maximum advantage of the finger action.

While it is to be understood that our trap is symmetrical in construction and in function, with the turning members 20 on the right hand side of the centerline 30 serving equally as well as the members 20 on the left side of the centerline to cause a ball approaching at a location offset from the centerline 30 to enter the trap, we have for convenience shown in FIG. 4 on the left-hand side of the trap, a line 32 representing the path a ball can take and still be caused by the respective ramp members 20 to turn and properly enter the trap.

As is to be inferred from the preceding description, a ball could be displaced a like distance to the right of the centerline 30 and still be caused by certain ones of the turning members 20 to enter the trap, rather than being deflected away.

Also to be noted in FIG. 4 are a plurality of spokes 26, which meet at a center locator 28. A hole may optionally be provided in the center locator in the event the user desires to place a pennant staff, a flag staff or the like therein.

The star-like entry ramp point members in the device shown in FIG. 4 may be twenty-four in number, spaced at 15° intervals. These star-like entry ramp points members may be structured with thin weblike membranes connecting the points along the base for the full or partial length of these points, although we obviously are not to be limited to this construction.

Figure 5:
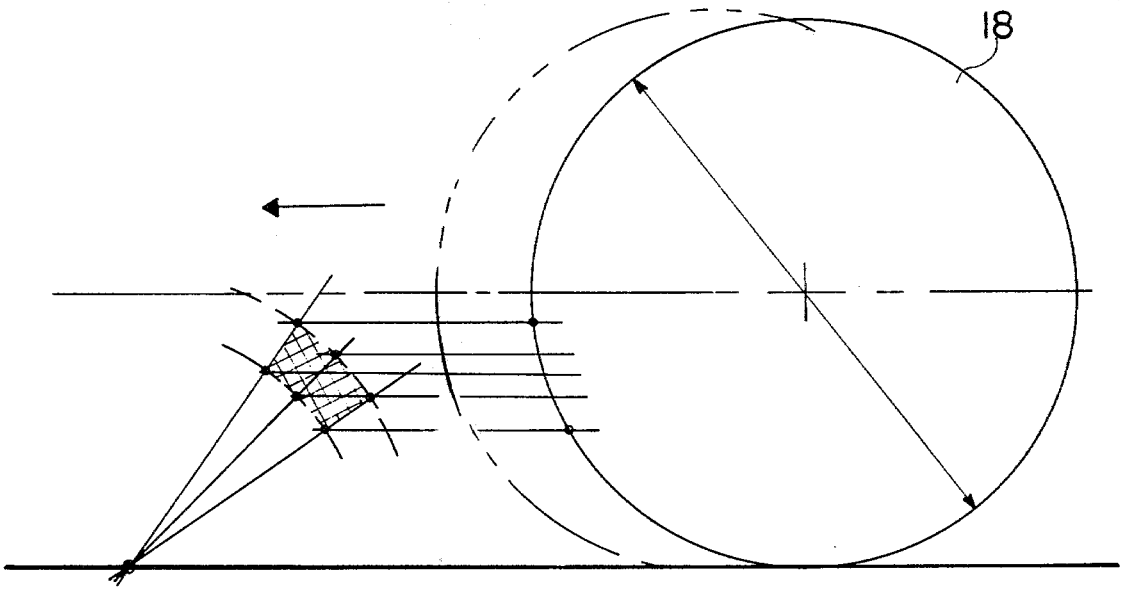
FIG. 5 is a view showing various relationships that may exist between a ball and the tip of a tine, and likewise showing permissible variations in tine length.

Turning to FIG. 5, it will there be seen that we have shown various relationships between an exemplary tine and an approaching ball, with permissible tine locations being shown to be at 35°, 45° and 55° to a horizontal surface. It is to be noted that a plurality of tine lengths may be utilized in accordance with this invention, and for example, the tines may be two inches long, two and one-fourth inches long, or two and one-half inches long. In FIG. 5 we have shown an arc connecting the tips of tines at each angularity that are a length of 40% of ball diameter, as well as an arc connecting the tips of tines at each angularity that are a length of 60% of ball diameter. This defines a zone employed for the effective "chocking" principle for stopping the ball, and containing it in the trap.

There is some degree of latitude associated with the sizing of the tines insofar as both angularity and length are concerned, and for example when using a ball say 4.2 inches in diameter, it would be preferred to use tines of the shorter length or tines disposed at less angularity, whereas when using a ball say five inches in diameter, it may be preferred to use tines of greater length and/or angularity.

As pointed out hereinbefore, the tines may well function to stop an approaching ball by this "chocking" action, although in other instances the tines may hinge all the way backward and stop the ball by an action we refer to as "fencing", the latter being of course being shown in dashed lines in FIG. 2. In accordance with the fencing principle, the tine length will be comparatively great in relation to ball diameter.

As previously mentioned, despite the fact that many different types of hinges can be used, we prefer for a base portion of each tine to bottom against a portion of the ring when a certain elevation has been reached, which may vary a few degrees each side of the vertical.

Figure 6A:
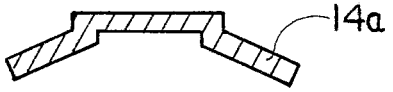
FIGS. 6*a* through 6*c* show typical cross sectional configurations of fingers, with such resulting in the fingers having column strength.
Figure 6B:
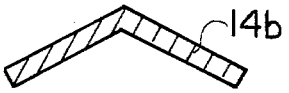
Figure 6C:
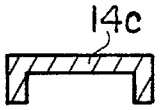

Although in FIGS. 6*a* through 6*c* we show tine midportions 14*a*, 14*b* and 14*c* depicting various cross sections that are suitable, we do not wish to be limited to these, because the tines can also be stiffened with a fold-like form, corrugated form, a structural bead formed lengthwise, and even a stiffening member imbedded along the tines length and in some other instance, a stiff member mechanically attached.

Tine stiffness can also be acquired with thick hard-back portion by essentially increasing the thickness along its length, and also with a taper incorporated along the tine's thickened length.

Although we show a hat shaped form and taper shape for the tine 'width' we do not wish to be limited to those forms and shape, because tines can be formed with essential cavitations, be straight, be with essential crown, and be with essential concave form along the tine length. The stiffness can be achieved with essential dihedral angles incorporated in their form.

The aforementioned substance, structure and forms are essentially practicable to the function of aiding the traveling ball insofar as guidance and entrapment are concerned.

The flexing segments of the device are critical to appropriate tine movement resulting from ball contact. Many suitable elastomeric materials available for use herein, such as polycarbonate, ABS plastic, polypropylene, rubber, vinyls and the like. We do not wish to be limited to a specific configuration or design with regard to the thickness, width, length, form, tine quantities, number of tine connection bend members attached to the ring, and the materials that are required for accomplishing the objects of the invention. Essentially the tine yields at the bend member area, under the force disposed by the proper weight, size and directional speed of the traveling ball it is to entrap, and it in each instance has sufficient resiliency to return to its desired preset position. The design of this member is contingent on the ball factors and the number of tines that a given ball encounters upon its entry. It is essential that the tines be restricted from exceeding a backward position that would permit the ball to roll through the device without a decided and obvious hop or bounce. This is accomplished by the use of the aforementioned stop feature provided in accordance with ring and tine design. Although integral tine hinges are preferred, separate hinges incorporating the features of desirable tine angularity and vertical stop may be utilized.

As should now be apparent, we have provided a low cost yet highly effective ball trap that can be constructed from any of a number of readily available materials, and which can be sized for use with a wide range of ball types and ball diameters. Intrinsic to our design is the use of a plurality of independently movable tines arrayed in a spaced relationship about the interior of the generally ring-shaped trap, with each tine residing in an angled relationship to the horizontal. The body portions of two, three or more adjacent tines can be contacted by a ball approaching the trap, and caused to hinge downwardly into an essentially horizontal position to permit entry of the ball into the trap. However, when the tines are approached by a ball in the interior of the trap, they serve, by virtue of the rigidity of their body portions and their angled relationship, to stop the ball and to retain it in the trap.

Our trap possesses qualities enabling it to entrap a lightweight ball of large diameter, for the novel tine arrangement readily enables entry of the ball into the trap, yet effectively inhibits the ball from thereafter leaving the trap. The turning means utilized about the outer circumference of the trap serve, even with a lightweight, large diameter ball, to meet the ball as it may approach at an angle to the center of the trap, and to direct the ball into the trap rather than causing it to veer away.

We claim:

1. A ball trap for use in connection with a type of golf game and the practice thereof, comprising a generally ring-shaped base member, around the inner portion of which a plurality of inwardly directed, elongate tines are disposed in spaced relation, each tine having a body portion of a lightweight construction designed to resist bending, and each tine being supported by an individual hinge means located at the lower end of such body portion where the body portion connects to the base member, each tine having a tip portion located at the end remote from said hinge means, with the tip portion of each tine supported at a position so as to have contact with the mid-portion of a ball entering the trap, the construction of each hinge means being such as to cause the respective tine normally to reside at an angle in the range between 35 degrees and 55 degrees to the horizontal, but upon the body portions of the tines being contacted by a ball rolling toward the trap, a plurality of adjacent tines can be caused to assume a generally horizontal position such that the ball can enter the trap, the tines contacted by the ball thereafter promptly resuming their original angled position after the ball has passed, the tip portions of the tines opposite the entry point being available to contact the ball after if has passed through the center portion of the trap, and to apply an arresting action to the ball by virtue of the comparatively rigid construction of said body portions, the hinge means supporting each tine being provided with stop means to prevent upward tine rotation beyond a position in which the body portion is essentially vertical, thus inhibiting a ball from leaving the trap.

2. A ball trap for use in connection with a type of golf game and the practice thereof, comprising a generally ring-shaped base member, around the inner portion of which a plurality of inwardly directed, elongate tines are disposed in spaced relation, each tine having a body portion of a lightweight construction designed to resist bending, and each tine being supported by an individual hinge means located at the lower end of such body portion where the body portion connects to the base member, each tine having a tip portion located at the end remote from said hinge means, with the tip portion of each tine supported at a position so as to have contact with the mid-portion of a ball entering the trap, the construction of each hinge means being such as to cause the respective tine normally to reside at an angle in the range between 35 degrees and 55 degrees to the horizontal, but upon the body portions of the tines being contacted by a ball rolling toward the trap, a plurality of adjacent tines can be caused to assume a generally horizontal position such that the ball can enter the trap, the tines contacted by the ball thereafter promptly resuming their original angled position after the ball has passed, the tip portions of the tines opposite the entry point being available to contact the ball after it has passed through the center portion of the trap, and to apply an arresting action to the ball by virtue of the comparatively rigid construction of said body portions, the outer circumferential edge portion of the ring shaped base member being provided with a plurality of turning members, said turning members being spaced apart and serving with regard to a ball approaching at an angle to the base, to cause the ball to turn into the trap rather than being deflected away from the trap.

3. A ball trap for use in connection with a type of golf game and the practice thereof, comprising a generally ring-shaped base member, around the inner portion of which a plurality of inwardly directed, elongate tines are disposed in spaced relation, each tine having a narrow, finger-like body portion of a lightweight construction designed to resist bending, and each tine being supported by an individual hinge means located at the lower end of such body portion where the body portion connects to the base member, said tines being spaced apart in each instance, a distance approximately corresponding to the width of a tine body, each tine having a tip portion located at the end remote from said hinge means, with the tip portion of each tine supported at a position so as to have contact with the mid-portion of a ball entering the trap, the construction of each hinge means being such as to cause the respective tine normally to reside at an angle in the range between 35 degrees and 55 degrees to the horizontal, but upon the body portions of the tines being contacted by a ball rolling toward the trap, a plurality of adjacent tines can be caused to assume a generally horizontal position such that the ball can enter the trap, the tines contacted by the ball thereafter promptly resuming their original angled position after the ball has passed, the tip portions of the tines opposite the entry point being available to contact the ball after it has passed through the center portion of the trap, and to apply an arresting action to the ball by virtue of the comparatively rigid construction of said body portions, thereby to prevent the ball from leaving the trap.

4. The ball trap as defined in claim 3 wherein the tines originally contacted by the ball are available, after resuming their angled relationship, to prevent the ball from leaving the trap during possible rebound.

5. The ball trap as recited in claim 3 wherein the tines are plastic, with their body portions each being curved in cross section to increase rigidity.

6. The ball trap as defined in claim 3 wherein a center locator is integrally provided for positioning a pennant staff or the like.

7. A ball trap as recited in claim 3 in which a rigid and comparatively heavy ring is provided in association with said base member, said ring serving to substantially stiffen said base member and to anchor same against undesirable movement.

8. A ball trap for use in connection with a type of golf game, comprising a generally ring-shaped base member, around the inner portion of which a plurality of inwardly directed, elongate tines are disposed in spaced relation, each tine being supported by an individual hinge means at an angle in the range between 35 degrees and 55 degrees to the horizontal, each hinge means enabling its respective tine to pivot downwardly during entry of a ball into the trap, said tines being sized in relation to the ball used therewith such that the tip portion of each tine is normally available to contact the mid-portion of a ball entering the trap, each tine having a body portion designed to resist bending at such time as a ball entering the trap forcibly contacts its tip, whereby the forward motion of such ball is effectively arrested by tine action, the hinge means supporting each tine being provided with stop means to prevent upward tine rotation beyond a position in which the body portion is essentially vertical, thus inhibiting the ball from leaving the trap.

9. A ball trap for use in connection with a type of golf game, comprising a generally ring-shaped base member, around the inner portion of which a plurality of inwardly directed, elongated tines are disposed in spaced relation, each tine being supported by an individual hinge means at an angle in the range between 35 degrees and 55 degrees to the horizontal, each hinge means enabling its respective tine to pivot downwardly during entry of a ball into the trap, said tines being sized in relation to the ball used therewith such that the tip portion of each tine is normally available to contact the mid-portion of a ball entering the trap, each tine having a body portion designed to resist bending at such time as a ball entering the trap forcibly contacts its tip, whereby the forward motion of such ball is effectively arrested by tine action, the outer circumferential edge portion of the base member being provided with a plurality of turning members, said turning members being generally radially disposed, spaced apart, and configured to direct an approaching ball to turn into the trap rather than being deflected away from the trap.

10. A ball trap for use in connection with a type of golf game, comprising a generally ring-shaped base member, around the inner portion of which a plurality of inwardly directed, elongate tines of narrow width are disposed in spaced relation, each tine normally being supported by an individual hinge means at an angle in the range between 35 degrees and 55 degrees to the horizontal, each hinge means enabling its respective tine to pivot downwardly during entry of a ball into the trap, said tines being spaced apart a distance substantially corresponding to the width of a tine body, said tines being sized in relation to the ball used therewith such that the tip portion of each tine is normally available to contact the mid-portion of a ball entering the trap and thus accomplish a chocking action, each tine having a body portion designed to resist bending at such time as a ball entering the trap forcibly contacts its tip, such that the forward motion of such ball is effectively chocked by tine action, the hinge of each of said tines also permitting the respective tine to pivot upwardly for a limited extent, to an essentially vertical position on occasion, so as to prevent by a fencing action, the ball leaving the trap.

11. The ball trap as defined in claim 10 in which said hinge means is of such construction as to cause tines contacted by a ball to promptly resume their original angled position as soon as the ball has passed thereover.

12. The ball trap as defined in claim 10 wherein the tines are plastic and their body portions are curved in cross-section to increase rigidity.

13. The ball trap as defined in claim 10 in which the outer circumferential edge portion of the base member is provided with a plurality of turning members, configured to cause an approaching ball to turn into the trap rather than away from the trap.

* * * * *